US005390598A

United States Patent [19]

Stauffer

[11] Patent Number: 5,390,598

[45] Date of Patent: Feb. 21, 1995

[54] WIPING DEVICE FOR AN INTAGLIO PRINTING MACHINE

[75] Inventor: Willy Stauffer, Lausanne, Switzerland

[73] Assignee: De La Rue Giori S.A., Lausanne, Switzerland

[21] Appl. No.: 217,976

[22] Filed: Mar. 25, 1994

[30] Foreign Application Priority Data

Apr. 30, 1993 [CH] Switzerland ..... 01 318/93-9

[51] Int. Cl.[6] ..... B41F 9/10; B41F 9/12

[52] U.S. Cl. ..... 101/167; 101/425

[58] Field of Search ..... 101/155, 156, 157, 168, 101/169, 167, 425, 423

[56] References Cited

U.S. PATENT DOCUMENTS 4,135,448 1/1979 Moestue ..... 101/156
4,499,825 2/1985 Uno ..... 101/167

FOREIGN PATENT DOCUMENTS 0514756 11/1992 European Pat. Off. .
1517914 2/1968 France .
596988 3/1978 Switzerland .

OTHER PUBLICATIONS

International Search Report of Counterpart Swiss Application No. 131893.

*Primary Examiner*—J. Reed Fisher
*Attorney, Agent, or Firm*—Kane, Dalsimer, Sullivan, Kurucz, Levy, Eisele & Richard

[57] ABSTRACT

In an installation for cleaning the wiping cylinder (1) of an intaglio printing machine, including a plurality of cleaning elements in contact with the periphery of the wiping cylinder and constituted by brushes (4) and/or wiping blades (3) as well as at least one row of nozzles (7) ejecting a cleaning liquid, the first cleaning element (5) in contact with the surface of the cylinder is made of textile material, preferably made of porous synthetic fibers in the form of a web which is mounted, folded over on itself, on and along a rigid support (6), so as to extend beyond the latter.

6 Claims, 1 Drawing Sheet

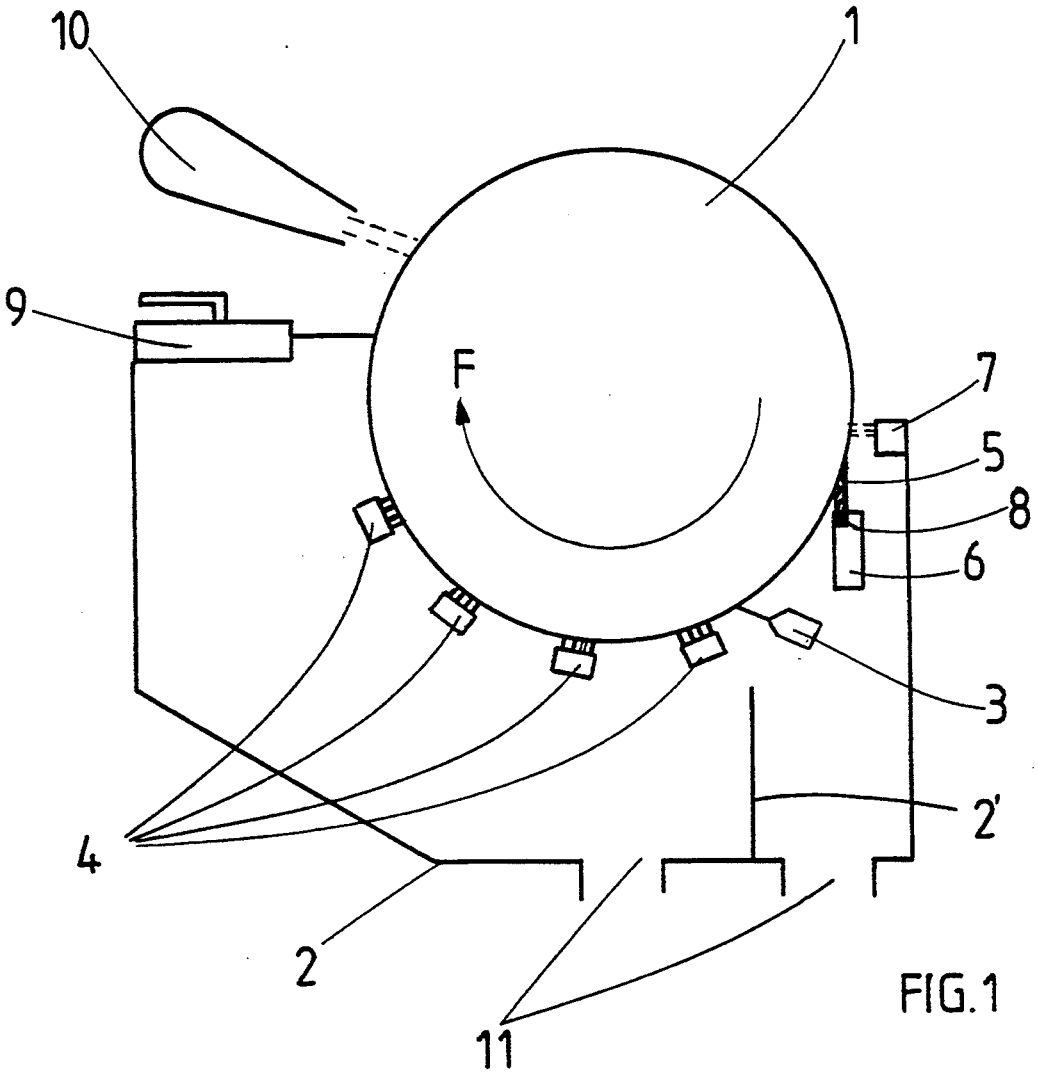
FIG. 1
FIG. 2
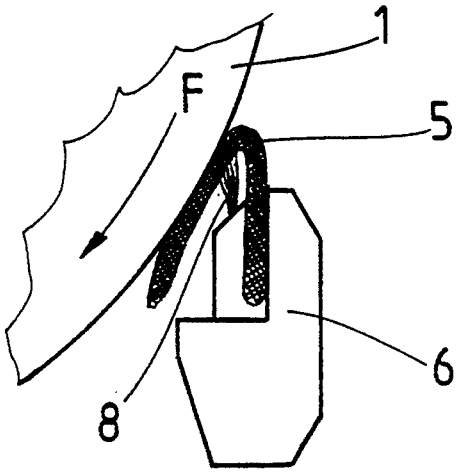

WIPING DEVICE FOR AN INTAGLIO PRINTING MACHINE

FIELD OF THE INVENTION

The present invention relates to a wiping device for an intaglio printing machine, comprising a wiping cylinder and an installation for the continuous cleaning of said cylinder, this installation including a container for receiving the cleaning liquid which continuously acts on the wiping cylinder and cleaning elements in contact with the periphery of the wiping cylinder, comprising, in the direction of rotation of this cylinder, a first cleaning element, which removes the greater part of the ink from the wiping cylinder, followed, at defined distances, by a plurality of other elements constituted by brushes and/or wiping blades, at least one row of nozzles parallel to the axis of the wiping cylinder, the nozzles being arranged in order to eject the cleaning liquid into the zone of the region of contact of said first cleaning element with the wiping cylinder.

PRIOR ART

According to Patent U.S. Pat. No. 4,236,450 of the filing company, an installation is already known for cleaning the wiping cylinder, in which the first cleaning element is constituted by a steel wiping blade which forms an acute angle with that periphery of the cylinder located after this wiping blade in the direction of rotation of the cylinder and is intended to remove the greater part of the ink. Although this wiping blade is very effective, since it enables by itself practically 90% of the ink to be removed from the surface of the wiping cylinder, it has been possible to show, with use, that, on account of the significant friction between the wiping blade and the cylinder, which friction is increased by the acute-angled inclination of the wiping blade with respect to the periphery of the wiping cylinder, the surface of the cylinder experiences very high wear forces which risk damaging it, the more so because this surface is made of synthetic material, especially PVC. Furthermore, it has been shown that the said wiping blade very rapidly becomes cutting, which accentuates the wear of the wiping cylinder and makes it necessary for the user to replace this wiping blade approximately every 24 hours.

SUMMARY OF THE INVENTION

The present invention proposes to overcome the drawbacks inherent in a steel wiping blade, sparing the surface of the wiping cylinder whilst decreasing the maintenance cost.

For this purpose, the installation according to the invention is one wherein the first cleaning element is made of textile material in the form of a web which is mounted, folded over on itself, on and along a rigid support, so as to extend beyond the latter. This textile material is preferably made of porous synthetic fibers.

Hitherto, the person skilled in the art was convinced that, in order to remove the greater part of the ink, the first cleaning element had necessarily to be made of a rigid, solid material, such as steel, and this is why the steel wiping blade was deemed to be necessary for many years. However, surprisingly, it has been discovered that the same effect was produced by an element made of a simple textile material, thereby avoiding the disadvantages of the steel wiping blade.

A first cleaning element is thus obtained which is as effective as a rigid wiping blade but which, by virtue of its softness, does not risk damaging the surface of the wiping cylinder, which therefore enables the lifetime of the latter to be increased. Another advantage is that, since the wear is less than with a steel wiping blade, the lifetime of the cleaning element itself is longer, of the order of eight days, which is clearly more economical for the user.

BRIEF DESCRIPTION OF THE DRAWING

The appended drawing represents, by way of example, one embodiment of the invention.

FIG. 1 shows a diagrammatic view of the device for cleaning the wiping cylinder.

FIG. 2 is an enlarged partial view of the zone of contact of the first cleaning element with the wiping cylinder.

DESCRIPTION OF THE PREFERRED EMBODIMENT(S)

The wiping device includes a wiping cylinder 1, rotating in the direction of the arrow F, intended to be in permanent contact with the plate cylinder, not shown, the direction of peripheral rotation of this wiping cylinder 1 being opposite to that of the plate cylinder. This wiping cylinder 1 is arranged partially inside a container 2 in which the cleaning installation is mounted. The surface of the wiping cylinder 1 is made of synthetic material, especially PVC, which ensures good wiping of the plate cylinder.

The cleaning installation includes, in a manner known per se, a plurality of cleaning elements constituted, in the example in question, by a wiping blade 3 forming an obtuse angle with that periphery of the cylinder 1 located after this wiping blade in the direction of rotation of said cylinder, and by brushes 4 arranged some distance away from each other around the periphery of the cylinder 1. These brushes 4, and, if necessary, the wiping blade 3, are mounted in the container 2 on a common rail enabling them to be simultaneously moved closer to or further away from the surface of the wipings cylinder 1. Nozzles for spraying a cleaning liquid, which are not shown, are associated with each of these brushes 4 so that that region of the cylinder 1 located before the contact zone of each cleaning element is moistened.

In front of the brushes 4 and the wiping blade 3, in the direction of rotation of the wiping cylinder 1, is mounted a first cleaning element 5 constituted by a textile material of porous synthetic fibers, having a thickness lying between 5 and 20 mm, preferably 10 mm, which is commercialized for example by the company 3 M under the name "Scotch-Brite" or "pads a main". This textile material is in the form of a web whose dimension in the axial direction of the cylinder corresponds to the latter's length so that the entire surface is covered, and which is mounted, folded over on itself (FIG. 2), on and along a support 6 so as to extend beyond the latter. The inclination of the support 6 is adjustable in order to set the contact pressure between the web of textile material and the surface of the cylinder 1, this support 6 being of the same configuration as the wiping-blade carrier which, in the previous installations, was intended to carry the steel wiping blade. This element 5, which is fixed in any known manner to the support 6, is provided in order to be applied tangentially over the entire length of the wiping cylinder 1 during the rotation of the latter, forming an acute angle with that periphery of the cylinder located after this element in the direction of rotation of the cylinder, and to rub its surface so as to remove approximately 90% of the quantity of ink present at the surface of the wiping cylinder. A row of spray nozzles 7, directed just in front of the zone of contact of said element 5 with the cylinder 1, is provided above the first cleaning element 5. A second row of nozzles 8 is provided in the support 6, the openings of which are directed towards the inside of the fold formed by the first cleaning element 5. These nozzles 7 and 8 are intended to send, under pressure, a cleaning liquid which, on the one hand, deterges the ink and, on the other hand, continuously moistens and rinses the cleaning element 5, which prevents the latter from becoming fouled up during the rubbing.

The cleaning liquid coming from the nozzles 7, 8 and from the nozzles associated with the brushes 4 is collected in the container 2 and flows through outlet orifices 11 so that the wiping cylinder 1 is not immersed in the soiled liquid. A separating wall 2' in the container 2 makes it possible to separate the cleaning liquid coming from the nozzles 7, 8, which is soiled by the greater quantity of ink, from the less dirty liquid coming from the nozzles associated with the brushes 4.

The ink residues at the surface of the wiping cylinder 1 are removed by virtue of the action of the wiping blade 3 in order to decrease the contamination of the brushes, and the complete cleaning is finished off by the brushes 4, in combination with the cleaning liquid ejected by the nozzles with which they are associated. Finally, after the brushes 4, a rigid blade 9, especially a steel blade, is provided which wipes the cylinder and partially dries it, and complete drying is achieved by the action of an air blower 10. Thus, the surface of the wiping cylinder 1 which will come once again into contact with the plate cylinder is clear of any trace of ink and is ready to perform its wiping role.

I claim:

1. A wiping device for an intaglio printing machine, comprising a wiping cylinder (1) having direction of rotation and length and an installation for the continuous cleaning of said cylinder, this installation including a container (2) for receiving the cleaning liquid which continuously acts on the wiping cylinder (t) and cleaning elements in contact with the periphery of the wiping cylinder, comprising, in the direction of rotation of this cylinder, a first cleaning element (5) acts on a relatively narrow part of the wiping cylinder (t) and removes the greater part of the ink from the wiping cylinder (1), followed, at defined distances, by a plurality of other cleaning elements, at least one row of nozzles (7, 8) parallel to the axis of the wiping cylinder, the nozzles being arranged in order to eject the cleaning liquid into the zone of the region of contact of said first cleaning element (5) with the wiping cylinder (1), wherein said first cleaning element (5) is made of textile material in the form of a web which is mounted, folded over on itself on and along the rigid support (6), so as to extend beyond the latter and tangentially over a narrow part and over the entire length of the wiping cylinder, the first cleaning element (5) having a pair of ends and being folded over on itself intermediate the ends, one end being on the rigid support (6) and the other end being free and extending in the direction of rotation of the wiping cylinder (1).

2. The device as claimed in claim 1, wherein the textile material is composed of porous synthetic fibers.

3. The device as claimed in claim 1, wherein the textile material has a thickness lying between 5 and 20 mm.

4. The device as claimed in claim 1, wherein the support (6) is adjustable in order to set the contact pressure between the web of textile material and the surface of the wiping cylinder (1).

5. The device as claimed in claim 1, wherein the nozzles (8) of one of said rows of nozzles are directed inside the fold formed by the web of textile material.

6. The invention as claimed in claim 1, wherein the other cleaning elements include brushes (4) and wiping blades (3).

* * * * *